United States Patent [19]

Kobayashi

[11] 4,403,456

[45] Sep. 13, 1983

[54] VIBRATORY BARREL FINISHING MACHINE

[75] Inventor: Hisamine Kobayashi, Nagoya, Japan

[73] Assignee: Shikishima Tipton Mfg. Co., Ltd., Nagoya, Japan

[21] Appl. No.: 297,168

[22] Filed: Aug. 28, 1981

[30] Foreign Application Priority Data

Sep. 12, 1980 [JP] Japan ..... 55-126803
Sep. 18, 1980 [JP] Japan ..... 55-132671[U]
Dec. 4, 1980 [JP] Japan ..... 55-174206[U]

[51] Int. Cl.[3] ..... B24B 31/00
[52] U.S. Cl. ..... 51/163.2
[58] Field of Search ..... 51/7, 163.1, 163.2, 51/16

[56] References Cited

U.S. PATENT DOCUMENTS 3,429,560 2/1969 Hubuer ..... 51/163.2
3,771,266 11/1973 Kobayeshi ..... 51/163.2
4,034,521 7/1977 Balz ..... 51/163.1
4,195,447 4/1980 Walther ..... 51/163.2

*Primary Examiner*—Harold D. Whitehead
*Attorney, Agent, or Firm*—Wenderoth, Lind & Ponack

[57] ABSTRACT

A vibratory barrel finishing machine comprises a single or multiple barrel arrangement of an elongated elliptical form in plan view including semicircular barrel sections at the opposite ends thereof and straight longitudinal barrel sections running in parallel and connecting between the opposite semi-circular barrel sections, the semi-circular barrel sections having descending-slope path in the direction of the flow of a mass (a mixture of unfinished workpieces and abrasive media) and straight barrel sections having ascending-slope path in the direction of the mass flow. The machine further includes workpiece guide means or workpiece advance control means which both provides the constant and smooth travel of the mass, particularly around the corners of the barrel structure, thus preventing the individual workpieces from impingement each other.

18 Claims, 31 Drawing Figures

VIBRATORY BARREL FINISHING MACHINE

BACKGROUND OF THE INVENTION

1. Field of the Invention

The present invention relates generally to a vibratory barrel finishing machine, and more perticularly to a workpiece finishing machine of the type which includes a single or multiple vibratory barrel of an elongated elliptical form in plan view having semi-circular sloped sections on the opposite sides and straight sloped sections between the semi-circular sections, the machine further including guide means for allowing workpieces to be travelling along the passage inside the barrel.

2. Description of the Prior Art

The prior art vibratory barrel finishing machines of the type disclosed herein are described, for example, in the specifications of the Japanese published examined patent application No. 50-16558 and published unexamined patent application No. 53-141995. The machines disclosed in those specifications include a horizontal-bottom barrel or a simply upward-sloped barrel. In those prior art machines, a mixture of workpieces and abrasive media (which is referred to as "mass") travelling under vibration inside the barrel causes a turbulent flow, which prevents a regular and smooth travel of the mass through the various points of the barrel. Around the curved corners of the barrel in particular, the turbulent flow in the mass itself also prevents the mass from advancing forward, thus making it stagnant at the corners. In the worst cases, the mass being accumulated at the corners may be flooded beyond the barrel at the corners. A number of improvements have been made to eliminate the above problems. One of the improvements, for example, employs a plurality of vibration generators each carrying a pair of unblanced weights, but it does not meet the practical needs since it requires a high degree of accuracy to ensure a proper synchronized operation of the unbalanced weight pairs in each vibration generator, including lead angles of the weights with regard to each other, and a very delicate fine rotating of each unbalanced weight pair is therefore required to permit each corresponding vibration generator to supply proper vibrations to the barrel.

The prior art vibratory barrel finishing machine presents the above disadvantages and difficulties particularly when workpieces such as large-size workpieces and precision-surfacing workpieces are to be processed in bulk quantities. The impingement of the workpieces with each other very often occurs while travelling under vibration inside the barrel, causing the interfering workpieces to suffer indentations on the surfaces due to the impact. This makes the precision surface finishing practically impossible. In order to obviate from those problems, an elliptical-form vibratory finishing barrel with an arcuate bottom is proposed, and a workpiece suspension means is also proposed for holding individual workpieces suspended from the above. But, this technical improvement is not satisfactory because the constructional problem of the barrel still causes a mass flood or over flow to occur at the barrel corners. As a result, the workpieces held in suspension cannot travel at constant speeds through the barrel, or the advance of the workpieces is prevented at the particular locations of the barrel where the mass flow is hindered. When a flexible suspension means is employed, it must hold the adjacent workpieces in greatly spaced relation with each other in order to keep them from interferring with each other. This is however practically of less utility, since the quantity of workpieces to be processed at a time must be limited. Otherwise, the defective indentations due to the impact of the adjacent workpieces are inevitably caused.

A further improvement proposes the provision of a number of partitions inside the barrel, as disclosed in the Japanese published unexamined patent application No. 52-92190, for example. This improvement has been made to the annular vibratory barrel finishing machine type, in order to protect the workpieces from the impingement caused by the interference of the workpieces. However, that type of machine has an annular form barrel in which the time interval or cycle time of the mass travelling through the entire barrel is shorter, restricting the quantity of workpieces to be processed at a time to relatively small. If larger quantities of workpieces are desired to be processed, it would of course be possible to provide a large barrel, which however would require a larger machine frame to be built, thus requiring a larger floor space on which such machine should be installed. As an alternative solution, a longer-run annular barrel with a horizontal bottom is employed, in which a workpiece advance control plate is provided. However, this does not allow for the constant and smooth travel of the mass because in this case the turbulent flow in the mass is also caused at the particular locations of the barrel as mentioned earlier, and in some extreme cases there is an overflow or flood of the mass beyond the barrel at the curved corners. As a result, an excessive load is placed on the above workpiece advance control plate, thus causing damages such as impingement on the workpieces. This alternative solution does not meet the practical needs.

SUMMARY OF THE INVENTION

An object of the present invention is therefore to provide an improved vibratory barrel finishing machine which is designed to include a particular form barrel and means to permit the workpieces to travel smoothly inside the barrel, thereby protecting the workpieces from the damages that otherwise may possibly be caused by the impingement of the workpieces with each other.

In order to achieve the above object, a vibratory finishing barrel of an elongated elliptical form in plan view is provided, which comprises one or several pairs of semi-circular sections on the opposite end thereof, and the corresponding pair or pairs of straight parallel sections connecting between the semi-circular sections. The semi-circular sections of the barrel have a descending-slope path in the direction of the mass flow, and the straight parallel sections provides an ascending-slope path in the direction of the mass flow. As such, it is possible to prevent the turbulent flow in the mass and thus prevent the mass from stagnating at the barrel corners. Therefor, the constant and smooth travel of the mass through the barrel can be ensured. The machine according to the present invention overcomes all the above-described problems of the prior art, and is capable of meeting the particular practical requirements.

Another object of the present invention is to provide an improved vibratory barrel finishing machine which is capable of in-line processing workpieces during one cycle of the finishing operations based on the selection of time intervals per charging a workpiece in the range of several seconds.

DESCRIPTION OF THE DRAWINGS

Those and other objects of the present invention will be more clearly seen from the following description to be made with reference to the accompanying drawings, in which.

DESCRIPTION OF THE PREFERRED EMBODIMENTS

Figure 1:
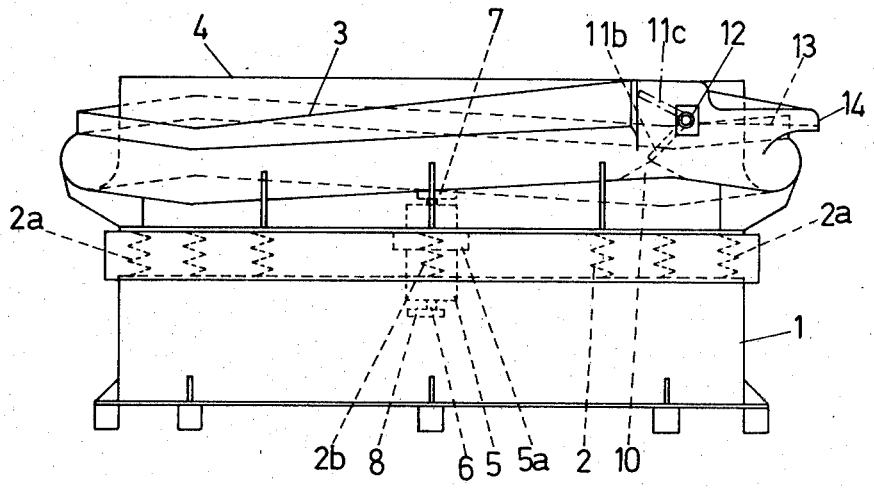
FIG. 1 is a front elevation illustrating the arrangement of the vibratory barrel finishing machine in one embodied form of the present invention.
Figure 2:
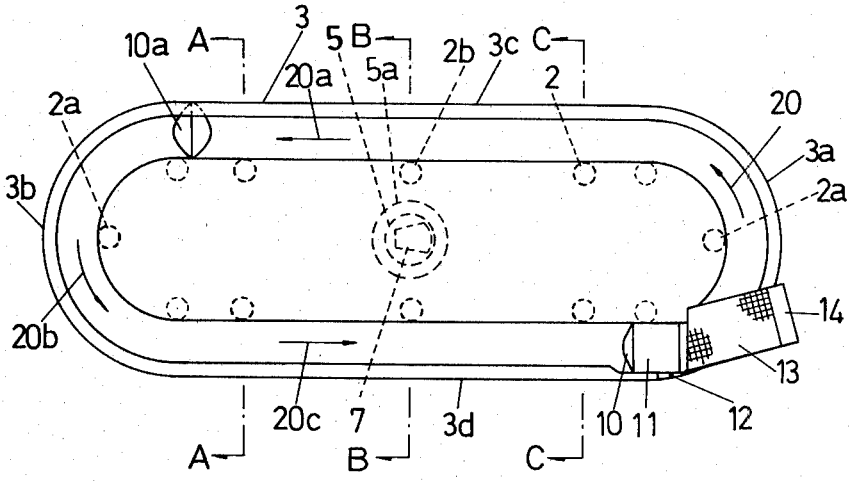
FIG. 2 is a plan view of FIG. 1.
Figure 4:
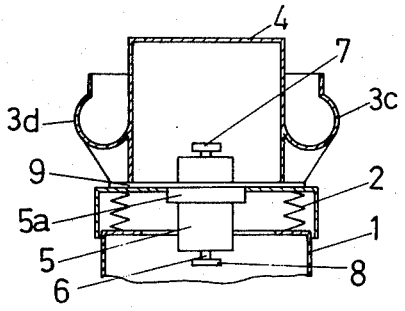
FIG. 4 is a sectional view taken along the line B—B in FIG. 2.

Referring first to FIGS. 1 and 2, one preferred embodiment of the present invention is described in details. In FIG. 2, the vibratory barrel finishing machine according to the present invention includes a barrel 3 of an elongated elliptical form in plan view, the barrel comprising one pair of semi-circular sections *3a, 3b* on the opposite ends thereof, and one pair of intermediate straight sections *3c, 3d* running in parallel on the opposite sides and connecting between the semi-circular sections. The semi-circular barrel sections *3a, 3b* have a descending slope in the direction of the flow of a mass (which is a mixture of workpieces and abrasive media), as indicated by arrows **20, 20*b*. The straight barrel sections *3c, 3d* have an ascending slope in the direction of the mass flow as indicated by arrows *20a, 20c*. The semi-circular sections and intermediate straight sections are interconnected at the respective butt ends to form an internal smooth travelling passage of the mass. The barrel 3 has a central housing 4 extending upwardly from the inner wall thereof, as shown in FIGS. 1 and 4. As particularly shown in FIG. 1, the barrel 3 is mounted on a pedestal 1 by means of intermediate springs 2, 2*a* which support the barrel such that it can have a vibratory motion caused by a vibration generating motor 5. The vibration generating motor 5 is provided below the barrel at the center thereof, and is equipped with a pair of unbalanced weights 7, 8. The motor 5 is fixed to the barrel 3 by securing the motor flange *5a* to the flange 9 provided below the barrel. The motor 5 has a vertical rotary shaft 6 to the opposite ends on which the unbalanced weights are mounted, respectively. The barrel 3 may have any form of a barrel, i.e., a open-top barrel having vertical inner and outer walls, a completely closed barrel of a full-circle cross-section, etc., provided that such barrel has an arcuate bottom in cross section. The shape in cross section of the barrel can be chosen as appropriate, depending upon the usage of the barrel, but most preferably the barrel should have a circular shape in cross section for the most part of the inner periphery thereof through which a mass flows, in order to permit a uniform and smooth travelling of the mass. Each of the springs 2, 2*a* to be used should have an identical spring constant. It may be possible that springs *2a* on the opposite sides of the longitudinal barrel axis have a greater spring constant than intermediate springs *2b*, or only several springs *2a* on the opposite sides with the intermediate springs *2b* omitted may be provided for supporting the barrel. The elongated elliptical barrel may be formed to provide a shorter axis-to-longer axis ratio which ranges between 1:2 and 1:30. The vibratory motor 5** as shown may be replaced by a vibration generator which has a vertical shaft equipped with a pair of unbalanced weights at the opposite ends. In this case, a separate driving motor is provided for imparting its driving power to the vibration generator by way of pulleys and belts, so that the generator can be driven for rotation to produce vibratory motion. Alternatively, a plurality of vibration generators with vertical shafts may be provided along the longitudinal central line across the barrel, each of the vertical rotary shafts carrying a pair of unbalanced weights at the opposite ends thereof such that the unbalanced weight pairs have equal lead angles and eccentric weight and are oriented in the identical directions. In this alternative form, each of the vertical rotary shafts has a sprocket or pulley secured thereto, and the sprockets or pulleys for the rotary shafts are interconnected by means of a chain or timing belt, thereby permitting the unbalanced weight pairs on the individual shafts to maintain equal lead angles and have a continuous rotation in the same direction in a synchronized relation with each other.

Employing the above-described barrel construction can accomplish the desired in-line operations which take place at selected time intervals. If required to meet the particular needs, the barrel may include a mass separating apparatus which permits a separation of the mass into processed workpieces and abrasive media. As particularly shown in FIGS. 1 and 2, the mass separating apparatus is provided at a location where the mass travelling path passes from the straight barrel section to the semi-circular barrel section, and includes a stationary dam 10 on the internal barrel bottom, a screening device 13 atop the barrel at the understream of the stationary dam 10, and rotatable flap 11 which opens and closes the gap between the stationary dam 10 and screening device 13. The mass separating apparatus as constructed above permits a continuous separation of the mass. The rotatable flap 11 has a rotary shaft 12 on which the flap pivots, closing the gap as indicated by 11*b* and opening the gap as indicated by 11*c*. In order to permit a constant or uniform flow of the mass through the barrel 3, one or a plurality of mass advancing control dam 10*a* may be provided at an appropriate points on the internal barrel bottom, which is later to be described in details. A workpiece charging apparatus (shown in FIGS. 18 and 19) including as chute or roller conveyor may also be provided at any appropriate location of the barrel 3, preferably in the neighborhood of the understream side of the earlier-mentioned mass separating apparatus. The position and number of the mass separating apparatus and workpiece charging apparatus, respectively, may be determined as appropriate, depending upon the particular arrangement of the equipment including the vibratory barrel finishing machine.

Figure 3:
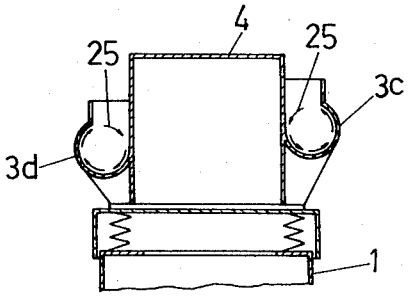
FIG. 3 is a sectional view taken along the line A—A in FIG. 2.
Figure 5:
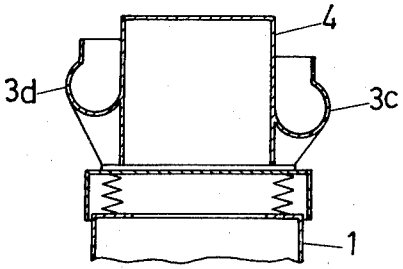
FIG. 5 is a sectional view taken along the line C—C in FIG. 2.

FIGS. 3, 4, and 5 are sectional views taken along the line A—A, B—B, and C—C in FIG. 2, respectively. It can clearly be seen from those figures that the intermediate straight sections 3*c* and 3*d* of the barrel 3 running in parallel opposite each other cross each other as viewed through the control line B—B across the barrel 3. This means that each straight section has an ascending slope in the opposite directions, that is, the barrel section 3*d* is ascending from the transverse line A—A toward the transverse line C—C while the barrel section 3*c* is ascending oppositely from the transverse line C—C toward the transverse line A—A. The barrel sections 3*c* and 3*d* are shown to cross each other on the transverse line B—B, but this crossing point may be varied depending upon the particular processing requirements.

Figure 6:
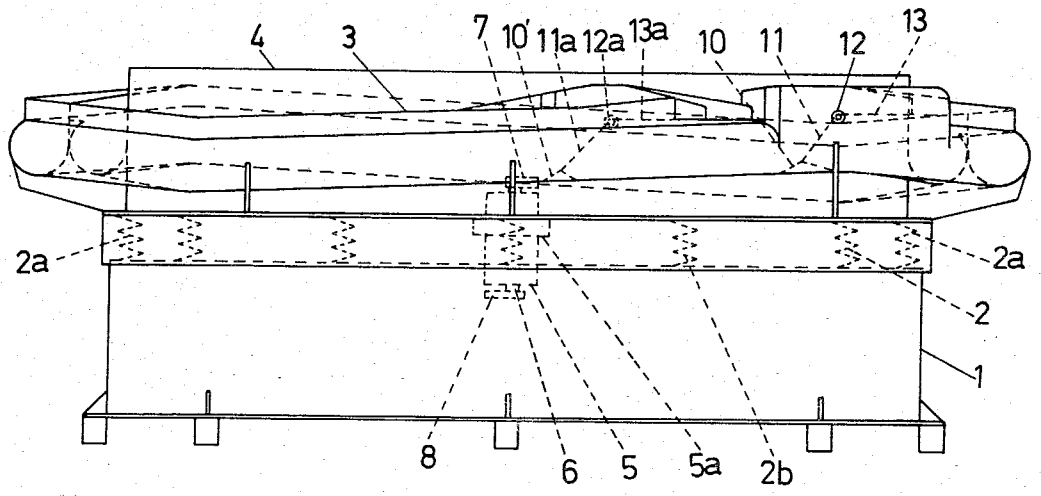
FIG. 6 is a front elevation illustrating the arrangement of the vibratory barrel finishing machine in another embodied form of the invention.
Figure 7:
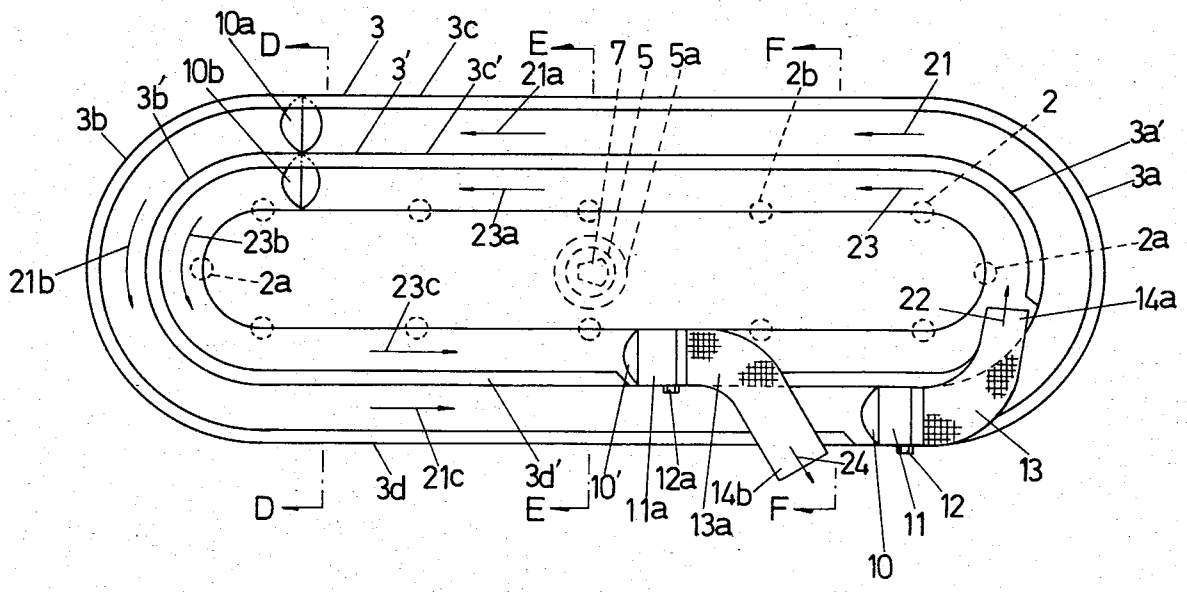
FIG. 7 is a plan view of FIG. 6.

Referring next to FIGS. 6 and 7, another preferred embodiment of the present invention is described. The bivratory barrel finishing machine shown in FIGS. 6 and 7 includes a dual barrel construction consisting of an inner barrel and an outer barrel. The barrel construction is such that the outer barrel is added to the inner barrel in the machine shown in FIGS. 1 and 2, the inner and outer barrels having an analogous shape. More specifically, the dual barrel construction includes two pairs of semi-circular barrel sections 3*a*, 3*b*, 3*a'*, 3*b'*, each pair at the opposite ends thereof providing a descending slope in the direction of the mass flow, and two pairs of straight barrel sections 3*c*, 3*d*, 3*c'*, 3*d'* running in parallel on the opposite longitudinal sides and connecting between the corresponding semi-circular barrel section pairs, each pair of the straight sections having an ascending slope in the direction of the mass flow. The machine in FIGS. 6 and 7 provides two different processing functions. As a variation of this embodiment, it is possible to provide a multiple barrel construction that consists of multiple barrels of analogous shape, and thus to permit the machine to provide many different processing functions that correspond to the number of the multiple barrels. The machine shown in FIGS. 6 and 7 includes similar operational elements to those of the machine in FIGS. 1 and 2 except that the former has multiple barrels as compared with the latter which has a single barrel. Therefore, the description of those similar elements is omitted for the convenience of simplicity, and is thus directed to those additional elements which are unique to the multiple barrel constuction.

Figure 8:
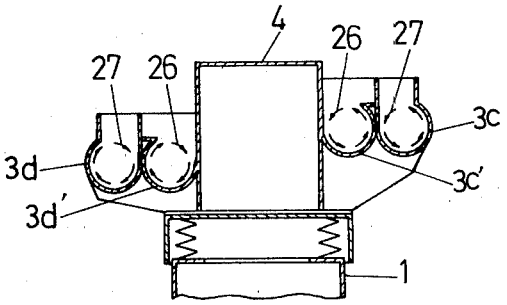
FIG. 8 is a sectional view taken along the line D—D in FIG. 7.
Figure 9:
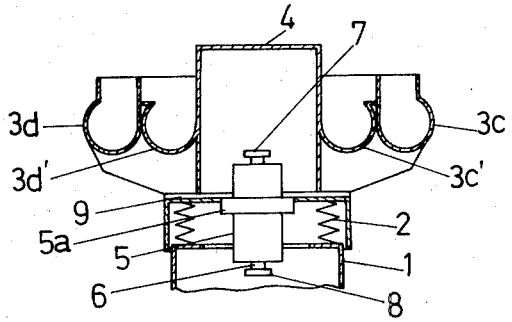
FIG. 9 is a sectional view taken along the line E—E in FIG. 7.
Figure 10:
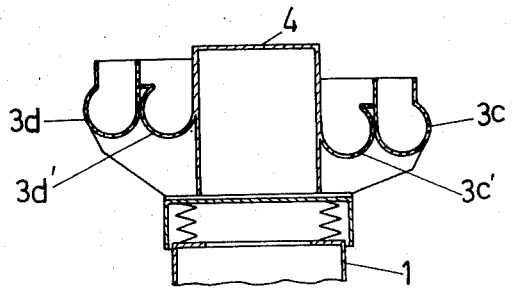
FIG. 10 is a sectional view taken along the line F—F in FIG. 7.

The dual barrel contruction machine including an inner barrel 3' and an outer barrel 3 as shown in FIGS. 6 and 7 further includes a mass separating screen 13 spanning the outer and inner barrels 3 and 3' such that its inlet side is located at the end of the mass travelling passage through the outer barrel 3 and its outlet side 14*a* is located over the inner barrel 3' so that the processed workpieces as well as abrasive media through the outer barrel are received at the inlet side and the workpieces can be guided through the screen 13 into the inner barrel 3'. Another mass separating screen 13*a* is provided, which spans the inner and outer barrels such that its inlet side is located at the end of the mass travelling path through the inner barrel and its outlet side 14*b* projects beyond the outer barrel so that the processed workpieces as well as abrasive media through the inner barrel can be guided on the screen 13*a*, and the processed workpieces are discharged from the screen out of the machine. The multi-barrel construction machine in this embodiment may have varied forms and may also include the associated accessory devices as described in the earlier embodiment. FIGS. 8, 9 and 10 are sectional views taken along the respective lines D—D, E—E and F—F in FIG. 7.

Figure 11:
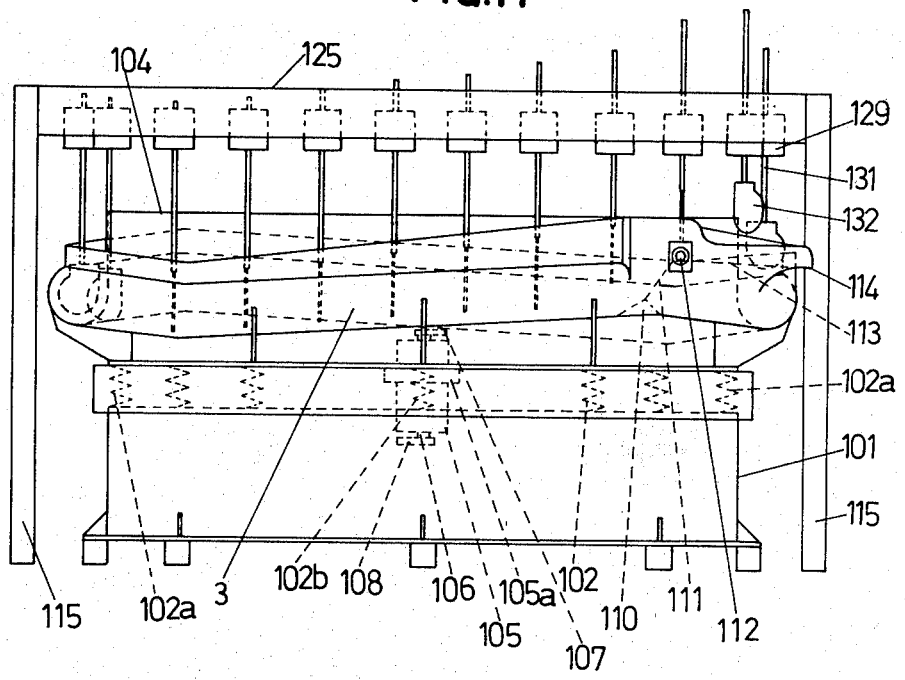
FIG. 11 is a front elevation of another embodiment of the present invention including a workpiece advance control means.
Figure 12:
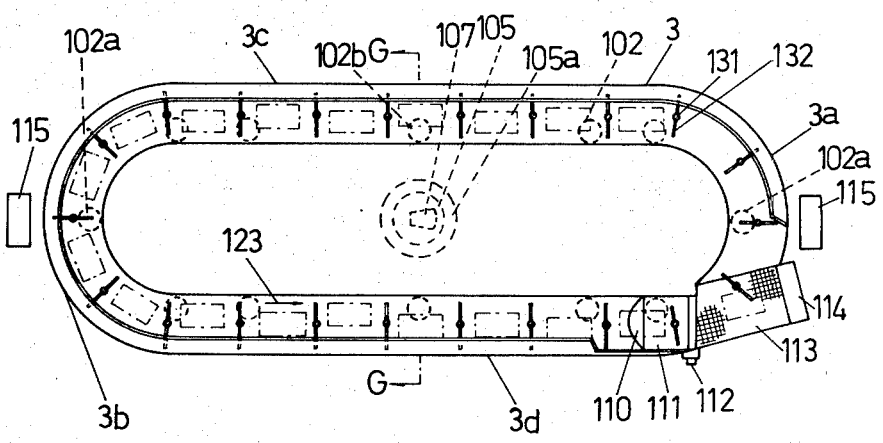
FIG. 12 is a partly plan view of FIG. 11.
Figure 23:
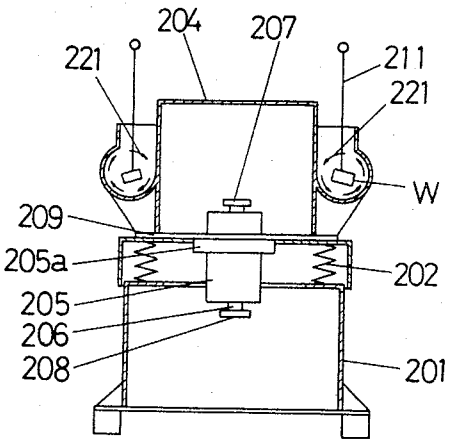
FIG. 23 is a sectional view taken along the line I—I in FIG. 22.
Figure 14:
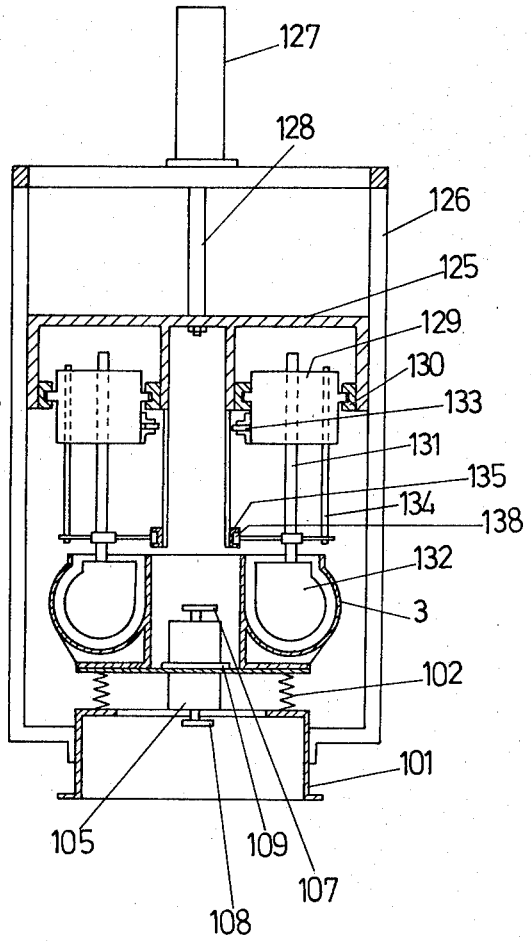
FIG. 14 is a sectional view showing one example of the workpiece advance control means provided in the machine.
Figure 15:
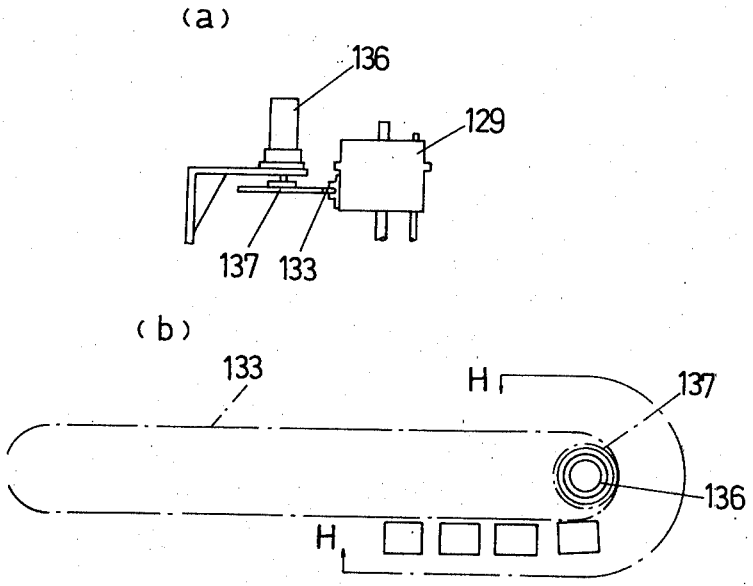
FIGs. 15 (a) and (b) are illustrative diagrams for the control plate rod having drive.
Figure 16:
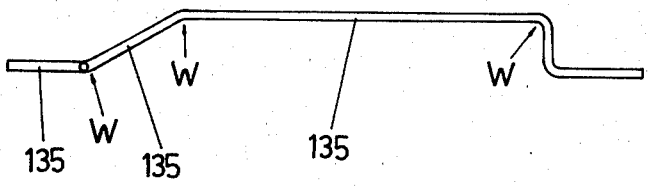
FIG. 16 is an exploded view along the line H—H in FIG. 12(b)

Referring particularly to FIGS. 11 and 12, another preferred embodiment of the present invention is described. Since the barrel construction, whether it may be a single barrel or multiple barrel construction, is substantially similar to those in the two earlier embodiments, the description regarding the barrel construction is omitted. The vibratory barrel finishing machine according to this embodiment has a single barrel construction which includes a workpiece advancing control apparatus. In FIG. 11, a guide box 125 is supported by support posts 115 on the opposite sides such that the guide box 125 is located in the space above the open top of the annular barrel 3. The guide box 125 is provided with parallel guide rails 130 on the opposite internal sides, and accommodates a plurality of individual housings 129 which are capable of travelling along the guide rails inside the guide frame. Each of the housings 129 has a rod 131 which is capable of upward and downward movement through the housing, and each rod 131 has a workpiece advance control plate 132 secured to the lower end thereof. The workpiece advance control plates 132 secured to the rods 131 are arranged at regular intervals inside the barrel 3. The details of the workpiece advancing control apparatus are given in FIG. 14, in which a fluid-operated cylinder assembly 127 is secured to a frame 126, and has a piston rod 128 secured to the guide box 125 through the frame 126. The cylinder 127 is used when an abrasive media is put into the barrel or the workpiece advance control plates are not in use. In this case, the cylinder is operated so that it couses the entire workpiece advancing control apparatus to be moved up away from the barrel. The apparatus also has a roller guide 135 which is formed to the profile of the balrel and permits the control plates 132 to travel inside the barrel along its profile. Reference numeral 138 designates a roller which engages with the roller guide 135 and is capable of sliding movement inside the roller guide. A guide 134 is provided for positionning the roller guide 135. FIG. 15 (a) illustrates the driving means of the control plate rod carrying box 129. In FIG. 15 (a), the shaft of a drive motor 136 has a sprocket 137 secured thereto, which is in mesh with a sprocket chain 133 for causing the individual housings 129 to travel. FIG. 16 is an exploded view along the line H—H in FIG. 15 (b), showing the roller guide 135 is raised to move the control plates 132 up relative to one side of the barrel shown in FIG. 15 (b), near the screening point.

Figure 17:
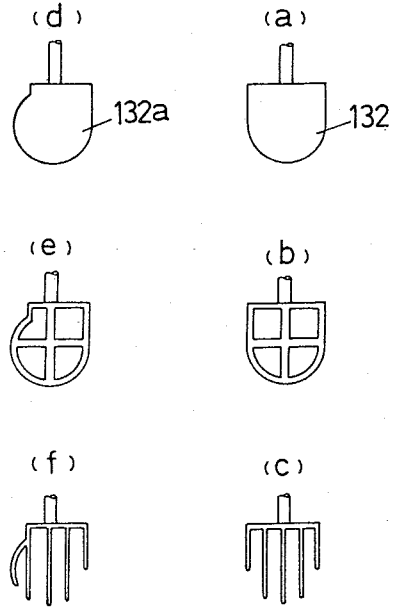
FIGS. 17 (a), (b), (c), (d), (e), and (f) illustrates other examples of the workpiece advance control plate, respectively.
Figure 13:
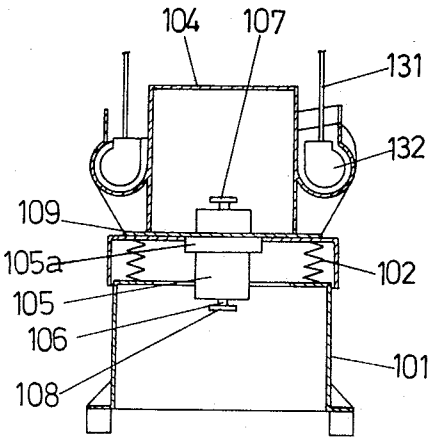
FIG. 13 is a partly sectional view taken along the line G—G in FIG. 12.

The profile shape of the individual control plates conforms to the shape in cross-section of the barrel used, and may be of varying form such as a flat plate, grid plate, forked plate, etc., depending upon the usage thereof. Examples of these are shown in FIG. 17.

Figure 18:
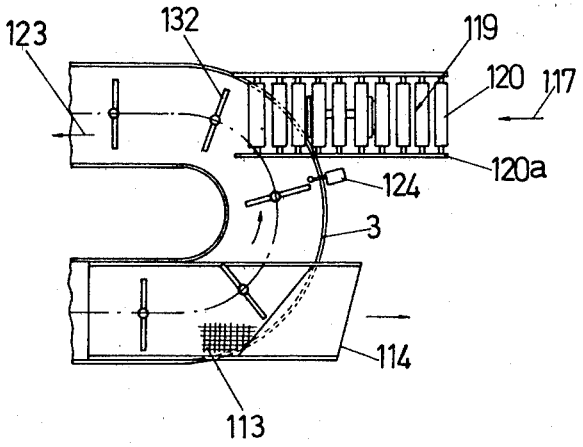
FIG. 18 is a plan view showing the workpiece charging apparatus and the mass separating apparatus.
Figure 19:
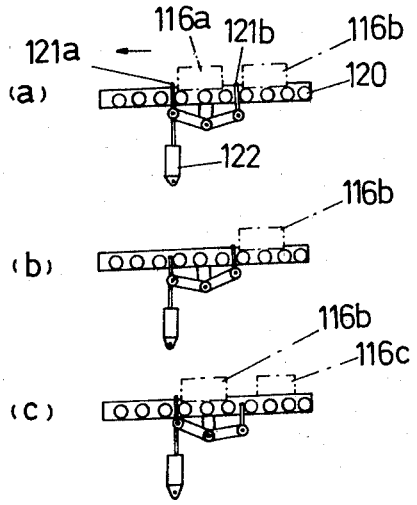
FIGS. 19 (a), (b), and (c) are diagrams illustrating the operation of one example of the workpiece charge control apparatus.
Figure 20:
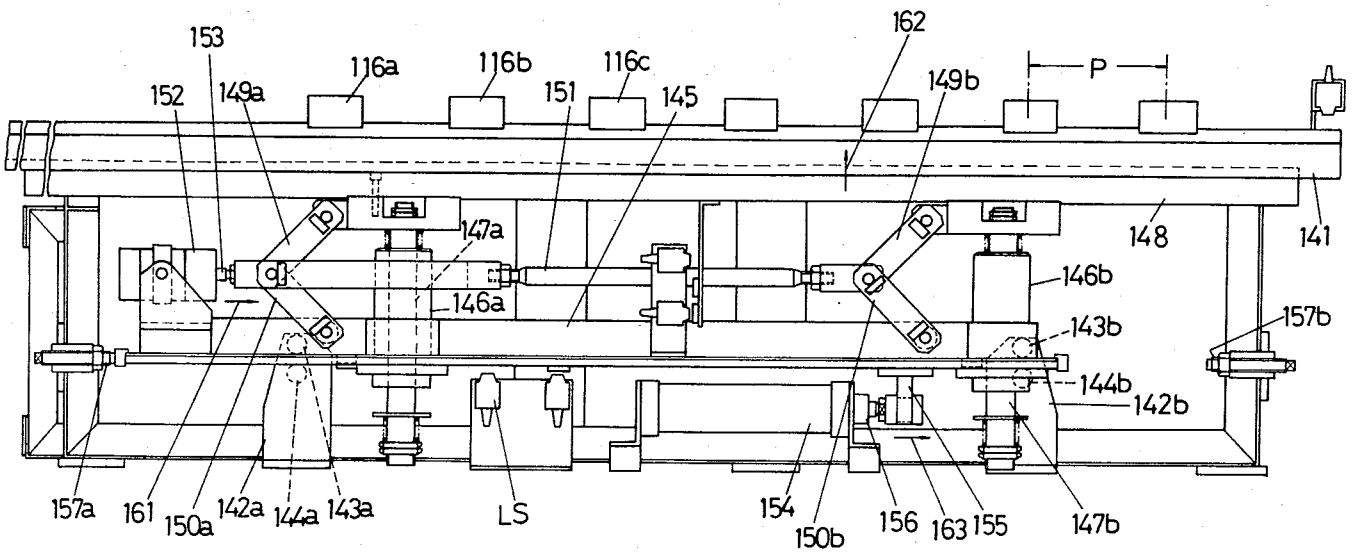
FIG. 20 is a side elevation of one example of the carrier apparatus.

As described in the two earlier embodiments, the workpiece charging apparatus 119 may be provided at any appropriate location of the barrel, as shown in FIGS. 18 and 19. Workpieces are charged into the barrel as indicated by an arrow 117. The workpiece charging apparatus includes a series of rollers 120 arranged in the longitudinal direction and rotatably fixed to parallel frames 120*a* on the opposite sides thereof, workpiece stoppers 121*a* and 121*b*, and a fluid-operated cylinder 122. The charging apparatus has the form of a roller conveyor which includes a combination of the fluide-operated cylinder and stoppers as shown in FIG. 19. As an alternative to the cylinder and stopper combination, a combination of an intermittent carrier and rollers may be employed to ensure the feeding of the individual workpieces as shown in FIG. 20. In FIG. 20, a pedestal 141 provides a base which supports the carrier apparatus, and is placed stationary on the floor. As shown in FIG. 20, individual workpieces 116*a*, 116*b*, 116*c*, etc. carried by the carrier apparatus can be moved at regular pitches P by means of an appropriate mechanism which will later be described. In order to permit the regular pitch motion of workpieces, a plurality of pins (not shown) are provided for holding the individual workpieces which are being fed onto the carrier passage. Under the base 141 are provided a plurality of roller support beds (two beds 142*a*, 142*b* are shown) which are rigidly mounted and carry a pair of opposite rollers 143*a*, 144*a* and a pair of opposite rollers 143*b*, 144*b*, respectively, for rotation. A carrier support member 145 is supported between the roller pairs 143*a*, 144*a* and 143*b*, 144*b* such that the member 145 is capable of sliding movement in the longitudinal direction. As described, the roller pairs are rotatably carried, and therefore reduces the frictional action between the rollers and the carrier support member 145 so that it can have a smooth longitudinal aliding movement. The carrier support member 145 has a plurality of bearing blocks (two blocks 146*a* and 146*b* are shown) thereon, through which vertical shafts 147*a* and 147*b* are provided for sliding movement. A longitudinal carrier plate 148 spanning the two shafts 149*a* and 149*b* is secured to the upper ends of the shafts. Elbow-shaped assemblies are provided adjacent to the corresponding bearing blocks 146*a* and 146*b*, and are operated for raising or lowering the carrier plate 148. One elbow-shaped assembly includes two arm members 149*a* and 150*a* one of which has one end thereof connected to the carrier plate 148 and the other of which has one end thereof connected to the carrier support member 145. The two arm members 149*a* and 150*a* are connected with each other at the other ends thereof so that they are capable of opening and closing through small angles. Similarly, the other elbow-shaped assembly includes two arm members 149*b* and 150*b* one of which has one end thereof connected to the carrier plate 148 and the other of which has one end thereof connected to the carrier support member 145. The two arm members 149*b* and 150*b* are connected with each other at the other ends thereof so that they are capable of opening and closing through small angles. The two elbow-shaped assemblies are connected with each other by means of an intermediate link member 151. The opposite ends of the link member 151 are connected to the corresponding elbow-shaped assemblies by means of pins so that the operation of the link can permit the elbow-shaped assemblies to open and close, simultaneously. The one of link member 151 has an extension whose end is connected to a piston rod 153 of a fluid-operated (hydraulic or pneumatic) cylinder 152. As easily understood from the above, the two elbow-shaped assemblies are controlled by the link, which is in turn controlled by the cylinder. When the piston rod 153 is completely withdrawn inside the cylinder block as shown in FIG. 20, the two arm members in each of the assemblies are placed in a closed position like an elbow shape, and when the piston rod is projecting, the arm members are placed in an open position with the arm members being aligned with each other. This means that the projecting piston rod pushes the link member in the direction of an arrow 161, causing the arm members on both sides to open gradually. The arm members which are this opening causes the carrier plate 148 gradually to be raised in the direction of an arrow 162 until finally they are completely opened. A stationary member 155 is rigidly secured to the underside of the carrier support member 145, and a piston rod 156 from a horizontally disposed fluid-operated cylincer 154 is connected with the stationary member 155. As clearly seen from FIG. 20, the withdrawing or projecting movement of the piston rod relative to the cylinder causes the carrier support member 145, and consequently the carrier plate 148 to be moved in the corresponding longitudinal direction. Stoppers 157*a* and 157*b* are provided on the opposite ends of the base 141, which rest against the corresponding ends of the carrier support member 145. There are provided a plurality of pins (not shown) on the carrier plate 148, and the pins have the function of holding and moving the individual workpieces on the carrier to be moved forward every one pitch P, when the piston rod 153 is projecting so that the carrier plate carrying the workpieces is moving up and each time the piston rod 156 is projecting as that the carrier support member can be made to move in the direction of an arrow 163.

Figure 21:
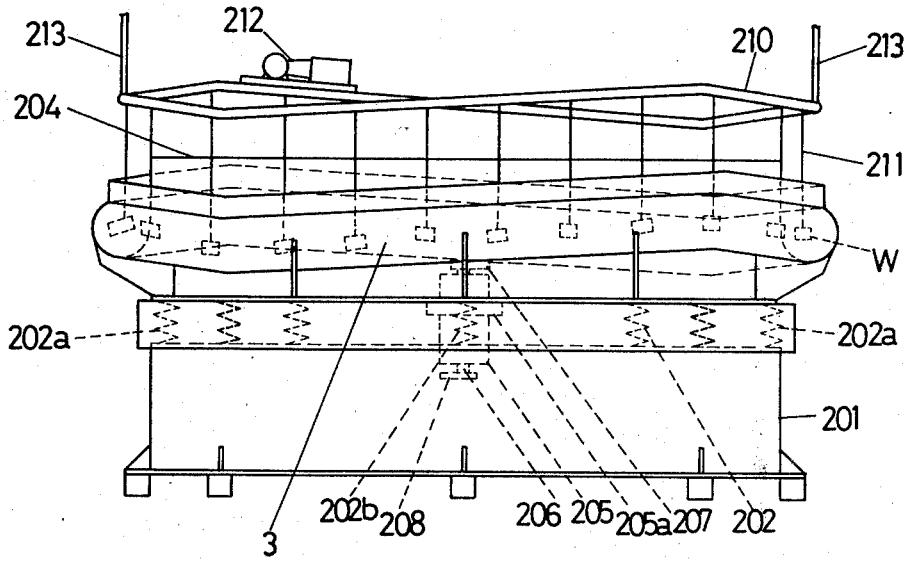
FIG. 21 is a front elevation of another preferred embodiment including a working suspension device.
Figure 22:
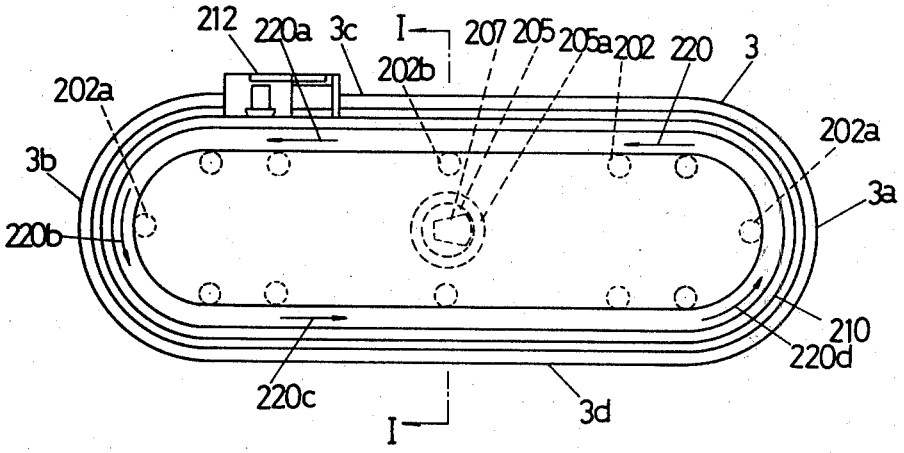
FIG. 22 is a plan view of FIG. 21.

In a preferred embodiment of the present invention depicted in FIGS. 21 and 22, a guide arrangement 210 having the form of a rail is provided in the space above the open top of an annular barrel 3, and is supported in suspension by support members 213 from the above. The guide arrangement 210 has the two-dimentional configuration which corresponds to that of the barrel 3 such that it follows the profile of the barrel, and carries a plurality of workpiece suspension members 211 which are spaced at regular intervals and include mounting means at the lower ends thereof for mounting each individual workpiece W to the respective suspension members 211. Thus, the individual workpieces carried by the respective suspension members 211 are submerged in the abrasive media within the barrel 3, and are subjected to the finishing process. In its one form, the workpiece suspension members 211 may be made of flexible rods and their upper ends are slidably mounted on the above-mentioned guide rail 210. In this arrangement, the suspension members 211 are capable of forward sliding movement along the guide rail which is caused by the workpieces mounted to the lower ends of the members which are travelling together with the abrasive media inside the vibrating barrel 3. In its alternative form, the suspension members 211 may be made of rigid rods, and include gears secured to the upper ends thereof which mesh with a rack provided in the guide 210. In this variation, a guide assembly is provided for allowing the suspension members to travel in the direction of the flow of the mass or forcing the suspension members to travel in the reverse direction of the flow of the mass. For this purpose, as shown, the guide assembly includes a driving system 212 mounted above the guide 210 and consisting of a drive motor and reduction gears, and a transmission chain meshed with the gears at the upper ends of the suspension members 211 for transmitting the driving power from the motor to the suspension members 211. In both cases, a workpiece loading or unloading station may be provided at an appropriate location of the guide 210. At this location, the loading or unloading operation takes place for the processed workpieces or unprocessed workpieces with respect to the suspension members which are moved away from the barrel 3.

The various preferred embodiments of the present invention and the variations thereof have been described with reference to the associated drawings. The operation is now described for each of those preferred embodiment. The fundamental principle of the operation which takes place with respect to the travel of the mass inside the barrel 3 applies likewise to all the preferred embodiments and variations thereof. This is then described by referring to the embodiment in FIGS. 1 and 2. For the operation, the vibratory motor 5 is first powered on, causing its vertical rotary shaft 6 to rotate in the clockwise direction in FIG. 2. This rotation places the barrel 3 above the motor under vibration so that the mass inside the barrel can have a spiral motion which consists of a circular motion component in the vertical plane as indicated by the arrow 25 in FIG. 3 and a forward motion component as indicated by the arrows 20, 20*a*, 20*b*, and 20*c* in FIG. 2. This spiral motion proceeds through the barrel 3. During the spiral motion, the mass is travelling through the barrel, following the profile of the barrel, that is, the mass is travelling up along the ascending-slope portion of the barrel and is travelling down along the descending-slope portion of the barrel. As described earlier, the annular barrel 3 has the curved corners specifically formed to provide down-slopes which permit a uniform and smooth flow of the mass without causing the mass to stagnate around the corners. In one form of the above embodiment, for example, in which the workpiece charging apparatus is provided in the neighborhood of the connection of the barrel sections 3*a* and 3*c* and each finishing operation for each batch of workpieces is completed after it circulated around the barrel, the rotatable flap 11 is always placed in its closed position as indicated by 11*b* in FIG. 1, permitting a mixture of processed workpieces and abrasive media to be led onto the screening device 13 where the mixture is to be separated into the abrasive media which is allowed to fall through the screen into the barrel for reuse, and the processed workpieces which are discharged outside the machine from the tip 14 of the screening device 13 for the purpose of any required subsequent processing. The period of time or one cycle time during which a mass is to circulate through the barrel can be set as desired, by changing the number of revolutions of the vibratory motor 5, the lead angle of the upper and lower unbalanced weight pairs. Therefore, each successive batch or piece of workpieces can be fed into the barrel at the regular intervals (such as time intervals of several seconds) from the workpiece charing apparatus. Thus, each batch or piece which has been processed through the barrel can be discharged piece by piece from the screen 14 at the same regular intervals. This can provide a line processing which takes place at regular intervals. For workpieces which require a longer time finishing process, the rotatable flap position is changed to its open position as indicated by 11*c* in FIG. 1. With the flap in its open position 11*c*, the workpiece continue to circulate through the barrel as long as the flap remains to be open. When it is determined that the workpieces have completely been processed, the flap is again placed in its closed position 11*b*, and the mass is then separated by the screening device in the above-described manner. The above-described operation is a typical batch operation. In this type of operation, the opening and closing operation of the rotatable flap 11 can be automated by means of a timer which is activated at the end of each completed finishing process so that it can operate a fluid-operated cylinder for operating the flap 11.

In the preferred embodiment shown in FIGS. 6 and 7, the machine is operated by first turning on the vibratory motor 5. The barrel operation takes place in the same manner as in the first embodiment. That is, driving the motor causes the dual barrels 3, 3' to be placed under vibration. The mass at its initial position within the outer barrels 3, is then given a vibrating motion, which causes the mass to have a spiral motion which consists of a circular motion component in the vertical plane as indicated by arrows 26 and 27 in FIG. 8 and a forward motion component as indicated by arrows 21, 21*a*, 21*b*, 21*c*, 23, 23*a*, 23*b*, and 23*c* in FIG. 7. In one form of this embodiment, the workpiece charging apparatus is provided in the neighborhood of the connection between the barrel sections 3*a* and 3*c* of the outer barrel 3. Workpieces fed from the charging apparatus into the outer barrel start to move forward together with abrasive media through the outer barrel as indicated by the arrows 21, 21*a*, 21*b* and 21*c*. Semifinished workpieces which have been processed through the outer barrel reach the mass separating apparatus at the end of the outer barrel. The mass separating apparatus, which includes the stationary dam 10, rotatable flap 11 and screen 13, allows the mass to be separated into workpieces and abrasive media. The workpieces are transferred from the tip 14*a* of the screen into the inner barrel 3'. The workpieces now inside the inner barrel 3' again have the spiral motion, moving forward through the inner barrel as indicated by the arrows 23, 23*a*, 23*b*, and 23*c*. The workpieces, which have eventually been processed at the end of the inner barrel, are led onto the mass separating apparatus over the barrel 3', from the tip 14*b* of which the workpieces only are discharged out of the machine for any required subsequence processes. Like the earlier embodiment, this embodiment provides both the continuous line processing and batch processing facilities. Because of the dual or possible multiple barrel arrangement, a single machine in this embodiment can provide a series of different processing functions, such as a combination of rough finishing and final finishing, a combination of polishing and drying/anti-rusting processes. The combination of such and other processes may be selected as appropriate, depending upon the particular processing purposes and the kind of abrasive media chosen.

Next, the operation of the third embodiment shown in FIGS. 11 and 12 is described. This embodiment includes a single barrel 3 which contains abrasive media to the full capacity of the barrel. For operation, the vibratory motor 105 is first powered on, causing the abrasive media to have a spiral motion as described in the two earlier embodiments, as indicated by an arrow 123. At the start of the operation, the workpiece advance control plates 132 hanging from the respective housing 129 are placed at regular intervals inside the barrel. Each individual workpiece is placed between the adjacent plates 132 from the workpiece charging apparatus 119, as indicated by the arrow 117 in FIG. 18. After setting all individual workpieces in place for having the finishing process, the workpiece advance control apparatus is driven by starting the drive motor 136, causing the control plates 132 to be moved forward at constant speed along the barrel in the direction of the arrow 123 in FIG. 12, carrying the workpieces in the same direction. The details of this operation is described later. The mixture of workpieces and abrasive media, or mass, is circulating around the barrel until finally it reaches the mass separating device at the end of the barrel passage, where the mass is separating into abrasive media which is again returned into the barrel, and processed workpieces which are discharged from the tip 114 of the screen 113 to outside the machine for any required subsequent processes. The circular motion of the advance control plates 132 is caused by driving the motor 136, as described. Driving the motor causes its sprocket to rotate, thus causing the chain 133 in mesh with the sprocket to run. Then, the housings 129 fixed to chain 133 are moved along the guide rails 125. The workpieces are thus moved together with the movement of the housings. As the portion of the roller guide 135 which is located in the neighborhood of the mass separating device has the form as shown in FIG. 16, those control plates which are located near the separating device raised away from the device, thus preventing those plates from contacting the device.

The workpiece charging apparatus 119 which includes the fluid-operated cylinder 122 and two stoppers **121*a* and 121*b* permits one workpiece after another to be put in proper place between succeeding adjacent control plates 132 in synchronized relation with the movement of the control plates 132. This is accomplished by the combination of a limit switch 124 and associated fluid-operated cylinder 122. That is, the limit switch 124 responds to the presence of a control plate which is coming near the limit switch, so that the limit switch is closed to deliver a signal which operates the cylinder 122. In response to the signal from the limit switch, the cylinder is operated such that its piston rod is retracted, causing the stopper 121*a* to be moved down and thus allowing a workpiece 116*a* to be put in proper place between the adjacent control plates which are located in front of that workpiece. As it is clearly seen from FIG. 19, the two stoppers 121*a* and 121*b* are operatively linked to each other such that the down-movement of one stopper has the effect of causing the other stopper to move up and vice versa. Thus, when the stopper 121*a* is moved down to allow a workpiece 116*a* in a ready position to be fed, a next workpiece 116*b* is stopped by the stopper 121*b* from moving to the ready position. When the cylinder is operated to have its piston rod projecting, the stopper 121*a* is moved up while at the same time the stopper 121*b* is moved down, allowing the next workpiece to move to the ready position. As readily understood, this arrangement prevents two or more workpieces from being fed at a time. The arrangement shown in FIGS. 18 and 19 may be replaced by the arrangement shown in FIG. 20 which permits an intermittent feeding of individual workpieces. When this arrangement (FIG. 20**) is used in conjunction with limit switches which control the intermittent operation, it ensure that individual workpieces can be fed into the barrel at more accurate timings.

The operation of the preferred embodiment including the workpiece suspension means is now described by referring to FIGS. 21 and 22. The initial step of starting the machine and the behaviour of the mass travelling inside the barrel are the same as those described with respect to the first embodiment. For ease of understanding the specific feature of this embodiment, the following description is limited to the operation of the workpiece suspension means by relating it to the barrel operation. In one form of the embodiment, the individual suspension members 211 have the respective upper ends mounted to the guide rail 210 in the sliding relation with the rail 210. In this arrangement, the individual workpieces W carried by the respective suspension members at the lower ends thereof and submerged in the abrasive media inside the barrel are allowed to travel with the abrasive media which is flowing in the direction as indicated by the arrows 220, **220*a*, 220*b*, 220*c*, and 220*d* in FIG. 22 under the action of the vibrating barrel. In the alternative form, the driving means 212 drives the chain inside the guide 210 so that the suspension members 211 fixed to the chain can be forced to travel in the same direction as the flow of the abrasive media or in the opposite direction. In the former form, one cycle time during which the workpieces circulate around the barrel can be adjusted by varying the number of revolution of the motor, the lead angles of the upper and lower unbalanced weights. Those individual workpieces which have completely been processed in the barrel are moved up away from the barrel at the workpiece loading and unloading station, where they are removed from the suspension members 211 and transferred to the next stage for further processing. At the above station, additional workpieces to be processed are mounted to the suspension members 211** from which the processed workpieces have just been removed. Succeeding cycles for the additional workpieces are repeated in the above-described manner.

In all the preferred embodiments described heretofor, the slopes angle of the parallel straight barrel sections should preferably be in the range of 0.1 and 10 degrees.

Although the invention has been described with reference to the various preferred embodiments thereof, it should be understood that various alterations and modifications may be made without departing from the spirit and scope of the invention.

What I claim is:

1. In a vibratory barrel finishing machine of the type having a single or multiple annular barrel structure of an elongated elliptical form in plan view including semi-circular barrel sections at the opposite ends thereof and straight longitudinal barrel sections running in parallel and connecting between the opposite semi-circular barrel sections, the barrel structure being adapted to have a vibratory motion to be supplied by vibration generating means such that the barrel structure under the vibration can allow the contents or mass therein to flow with a spiral motion through the barrel structure, said opposite semi-circular barrel sections each having a descending-slope path in the direction of the mass flow and said straight longitudinal barrel sections each having an ascending-slope path in the direction of the mass flow.

2. A machine as defined in claim 1, further including workpiece guide box means located in the space above the barrel structure and capable of up and down movement with respect to said barrel structure, said workpiece guide box means carrying a plurality of workpiece advance control rod housings travellably inside said guide box means, each of said housings having a workpiece advance control rod member capable of up and down movement through said housing and having a control plate at the bottom end thereof; and separating means located at appropriate point of said barrel structure and adapted for separating into processed workpieces and abrasive media.

3. A machine as defined in claim 2, wherein said workpiece guide box means includes a guide for said workpiece advance control rod housings, a traveller chain movably attached to said housings, drive motor means for moving said traveller chain, and sprocket wheel means on said motor means for engaging with said traveller chain.

4. A machine as defined in claim 3, wherein each of said workpiece advance control rod housings includes a member for attaching said housing to said traveller chain, and a roller engaging with said guide.

5. A machine as defined in claim 1, further including workpiece guide means supported in the space above the open top of the barrel structure and having a profile conforming to that of the barrel and carrying a plurality of workpiece suspension members adapted to travel along the profile of the barrel.

6. A machine as defined in claim 5, wherein said workpiece guide means comprises a traveller chain for said workpiece suspension members, gear means at the top of said workpiece suspension members, rack means in mesh with said gear means, and chain drive supply means.

7. A machine as defined in claim 6, wherein workpiece loading and unloading station is located at any appropriate point of said workpieces guide means.

8. A machine as defined in claim 5, wherein said workpiece guide means comprises a guide rail for allowing said workpiece suspension members freely to travel along the profile of the barrel, and said workpiece suspension members are made of flexible rod members capable of such free travel.

9. A machine as defined in claim 8, wherein workpiece loading and unloading station is located at any appropriate point of said workpiece guide means.

10. A machine as defined in claim 1, wherein said barrel structure includes one or more advance control dams located at appropriate points therein for controlling the advance of workpieces and/or abrasive media.

11. A machine as defined in claim 1, wherein said barrel structure has a substantially circular shape in vertical cross section for the most part of the inner periphery thereof through which a mass flows, along the entire length thereof.

12. A machine as defined in claim 1, wherein said barrel structure is supported by a plurality of spring means mounted between the bottom of said barrel structure and the pedestal on the floor, those of said spring means located on the opposite sides of the longitudinal barrel axis having a greater spring constant than the intermediate spring means.

13. A machine as defined in claim 1, wherein said barrel structure is only supported by said spring means on said opposite sides of said barrel axis.

14. A machine as defined in claim 1, wherein said barrel structure includes vibration supply means for driving said barrel structure for vibratory motion.

15. A machine as defined in claim 14, wherein said vibration supply means includes a single vibration generator located at the center below the barrel structure.

16. A machine as defined in claim 14, wherein said vibration supply means includes a plurality of vibration generators located below said barrel structure in alignment with the longitudinal center line across said barrel structure, said vibration generators being disposed with their respective rotary shafts extending perpendicularly to said barrel structure, each of said rotary shafts having pairs of unbalanced weights mounted at the upper and lower ends thereof such that all pairs are oriented in the same direction, the unbalanced weights in each pair having an equal lead angle and an eccentric weight with respect to each other; a sprocket or pulley member secured to each of said vertical rotary shafts; and a chain or timing belt for linking the sprocket or pulley members for the rotary shafts, whereby said unbalanced weight pairs can continuously be rotated in the same direction in synchronized relation with each other with said equal lead angles maintained with respect to the unbalanced weights in each pair.

17. A machine as defined in claim 1, further including separating means located at an appropriate point of said barrel structure for separating processed workpieces from abrasive media.

18. A machine as defined in claim 1, further including workpiece charging means located at an appropriate point of said barrel structure, said workpiece charging means at a definite time interval comprising a chute or roller conveyer.

* * * * *